United States Patent [19]

Waisberg

[11] Patent Number: 4,893,940

[45] Date of Patent: Jan. 16, 1990

[54] STIRRER DEVICE FOR A BEVERAGE PITCHER, AND BEVERAGE PITCHER INCORPORATING SUCH A STIRRER DEVICE

[76] Inventor: Stephen L. Waisberg, 6 Farningham Crescent, Islington, Ontario, Canada, M9B 3B5

[21] Appl. No.: 23,681

[22] Filed: Mar. 9, 1987

[51] Int. Cl.[4] ..... B01F 7/18

[52] U.S. Cl. ..... 366/247; 366/325

[58] Field of Search ..... 366/242, 243, 244, 245, 366/247, 325, 327, 343, 129, 130, 347, 246, 248, 252, 309, 322, 318; 222/465.1, 240, 241, 226, 235, 562, 544, 572, 236; 74/545; 242/84.8; 68/134; 416/70 R, 234 R, 235, 237 R, 170 HM, 173, 234 A

[56] References Cited

U.S. PATENT DOCUMENTS

| | | | |
|---|---|---|---|
| 282,047 | 7/1883 | Bruck | 366/244 X |
| 1,069,861 | 8/1913 | Davidson | 366/327 X |
| 1,391,439 | 9/1921 | Williams | 366/343 |
| 1,612,281 | 12/1926 | Goetz | 366/244 |
| 2,034,631 | 3/1936 | Nelson | 68/134 |
| 2,073,540 | 3/1937 | Tittle | 68/134 |
| 2,123,600 | 7/1938 | Galante | 366/247 X |
| 3,078,058 | 2/1963 | Roe | 242/84.8 |
| 4,010,934 | 3/1977 | McCord et al. . | |
| 4,359,283 | 11/1982 | McClellan | 366/247 |
| 4,435,084 | 3/1984 | Calhoun et al. | 366/130 |
| 4,460,279 | 7/1984 | Krasney | 366/247 |

FOREIGN PATENT DOCUMENTS

| | | | |
|---|---|---|---|
| 55005 | 5/1922 | Sweden | 366/325 |

*Primary Examiner*—Philip R. Coe
*Assistant Examiner*—Scott J. Haughland
*Attorney, Agent, or Firm*—Ridout & Maybee

[57] ABSTRACT

There is provided a beverage pitcher in which is mounted a stirrer device for stirring or agitating the contents of the pitcher. The stirrer device includes a plurality of axially spaced vane lobes which are substantially equiangularly spaced about a longitudinal axis. The maximum radial extent of the vane lobes from the lognitudinal axis decreases in the direction from the lower end to the upper end of the plurality of vane lobes, so that during operative rotation of the vane lobes the stirring or agitating effect is at a minimum at the maximum upper level of the contents of the pitcher where only a minimum stirring or agitating effect is required and where substantial stirring or agitation is undesirable.

16 Claims, 3 Drawing Sheets

STIRRER DEVICE FOR A BEVERAGE PITCHER, AND BEVERAGE PITCHER INCORPORATING SUCH A STIRRER DEVICE

This invention is concerned with an improved form of stirrer device for a beverage pitcher, and with a beverage pitcher incorporating such a stirrer device. It is frequently necessary to stir or agitate the contents of a beverage pitcher. Thus, for example, where the contents of the pitcher consist of water to which has been added a flavouring powder or crystals it is usually necessary to stir or agitate these contents in order to dissolve the powder or crystals in the water before the beverage is consumed. Furthermore, particularly in the case of, for example, natural fruit juices, there is usually a tendency for particles of the fruit to settle to the bottom of the pitcher when the pitcher is left undisturbed for a period of time such as overnight, and it is of course desirable before the beverage is subsequently consumed for the contents of the pitcher to be stirred or agitated in order substantially uniformly to distribute these fruit particles throughout the beverage.

It has hitherto been proposed to provide a beverage pitcher in which there is porvided a stirrer device for stirring or agitating the contents of the pitcher, reference in this connection being made to, for example, U.S. Pat. No. 4,359,283 which issued on November 16, 1982 to Thomas A. McClellan. In the structure of McClellan the stirrer device comprises a helical vane which is of constant width in a radial direction and which extends from adjacent the bottom of the pitcher substantially to the maximum upper level of the contents of the pitcher. This is, however, unnecessary since in order to dissolve the powder or crystals in the water in the pitcher or substantially uniformly to distribute the fruit particles throughout the contents of the pitcher the maximum stirring or agitating effect is required adjacent to the bottom of the pitcher, with the stirring or agitating effect which is required being diminished in the upward direction from the bottom of the pitcher. Furthermore, not only is it unnecessary to provide the maximum stirring or agitating effect at or adjacent to the maximum upper level of the contents of the pitcher, but this is indeed undesirable since it may result in spillage of a portion of the contents from the pitcher or at least in the contents of the pitcher being splashed into the mechanism provided at the top of the stirrer device for rotation of the stirrer device and this results, of course, in cleaning of the pitcher and more particularly the rotation mechanism for the stirrer device being more difficult especially in the case of, for example, fruit juices, which tend to dry as a sticky film.

It is with the view to overcoming these disadvantages that in accordance with one aspect of the present invention there is provided an improved form of stirrer device for a beverage pitcher, and a beverage pitcher incorporating such a stirrer device.

In accordance with this one aspect of the present invention there is provided a stirrer device for a beverage pitcher, the stirrer device comprising elongated vane means which has a first end and an opposed second end and which comprises a plurality of axially spaced vane lobes substantially equiangularly spaced about a longitudinal axis, the maximum radial extent of the vane lobes from the longitudinal axis decreasing in the direction from said first end towards said second end of the vane means, and each vane lobe being of generally spiral form about the longitudinal axis with the edge thereof merging smoothly from the maximum radial extent of said vane lobe towards said longitudinal axis.

In accordance with a this one aspect of the present invention there is also provided in a beverage pitcher comprising a base wall, and upstanding side walls, a stirrer device which comprises elongated vane means rotatably mounted within the pitcher, the vane means having a lower end supported on the base wall and an opposed upper end, and comprising a plurality of axially spaced vane lobes which are substantially equiangularly spaced about the longitudinal axis, the maximum radial extent of the vane lobes from the longitudinal axis decreasing in the direction from said lower end towards said upper end of the vane means, and each vane lobe being of generally spiral form about the longitudinal axis with the edge thereof merging smoothly from the maximum radial extent of said vane lobe towards said longitudinal axis.

Furthermore, in accordance with a further aspect of the present invention there is provided a stirrer device for a beverage pitcher, the stirrer device comprising vane means which has a first end and an opposed second end, and a plate to one face of which the second end of the vane means is nonrotatably mountable, the opposed face of the plate having blind fingertip recess means for operative rotation of the plate and the vane means about the longitudinal axis thereof but being otherwise substantially flush, and the vane means comprising a plurality of axially spaced vane lobes which are substantially equiangularly spaced about the longitudinal axis, and each of which is of generally spiral form about the longitudinal axis, with the maximum radial extent of the vane lobes from the longitudinal axis decreasing in the direction from said first end towards said second end of the vane means.

In accordance with this further aspect of the present invention there is also provided in a beverage pitcher comprising a base wall, and upstanding side walls, a stirrer device which comprises vane means rotatably mounted within the pitcher and having a lower end supported on the base wall and an opposed upper end, and a plate to a lower face of which the upper end of the vane means is non-rotatably mounted, an upper face of the plate having blind fingertip recess means for operative rotation of the plate and the vane means about the longitudinal axis thereof but being otherwise substantially flush, and the vane means comprising a plurality of axially spaced vane lobes which are substantially equiangularly spaced about the longitudinal axis, and each of which is of generally spiral form about the longitudinal axis, with the maximum radial extent of the vane lobes from the longitudinal axis decreasing in the direction from the lower end towards the upper end of the vane means.

In order that the invention may be more clearly understood and more readily carried into effect the same will now, by way of example, be more fully described with reference to the accompanying drawings in which FIG. 1 is a cross-sectioned view of a beverage pitcher incorporating a stirrer device according to a preferred embodiment of the present invention;

Figure 1:
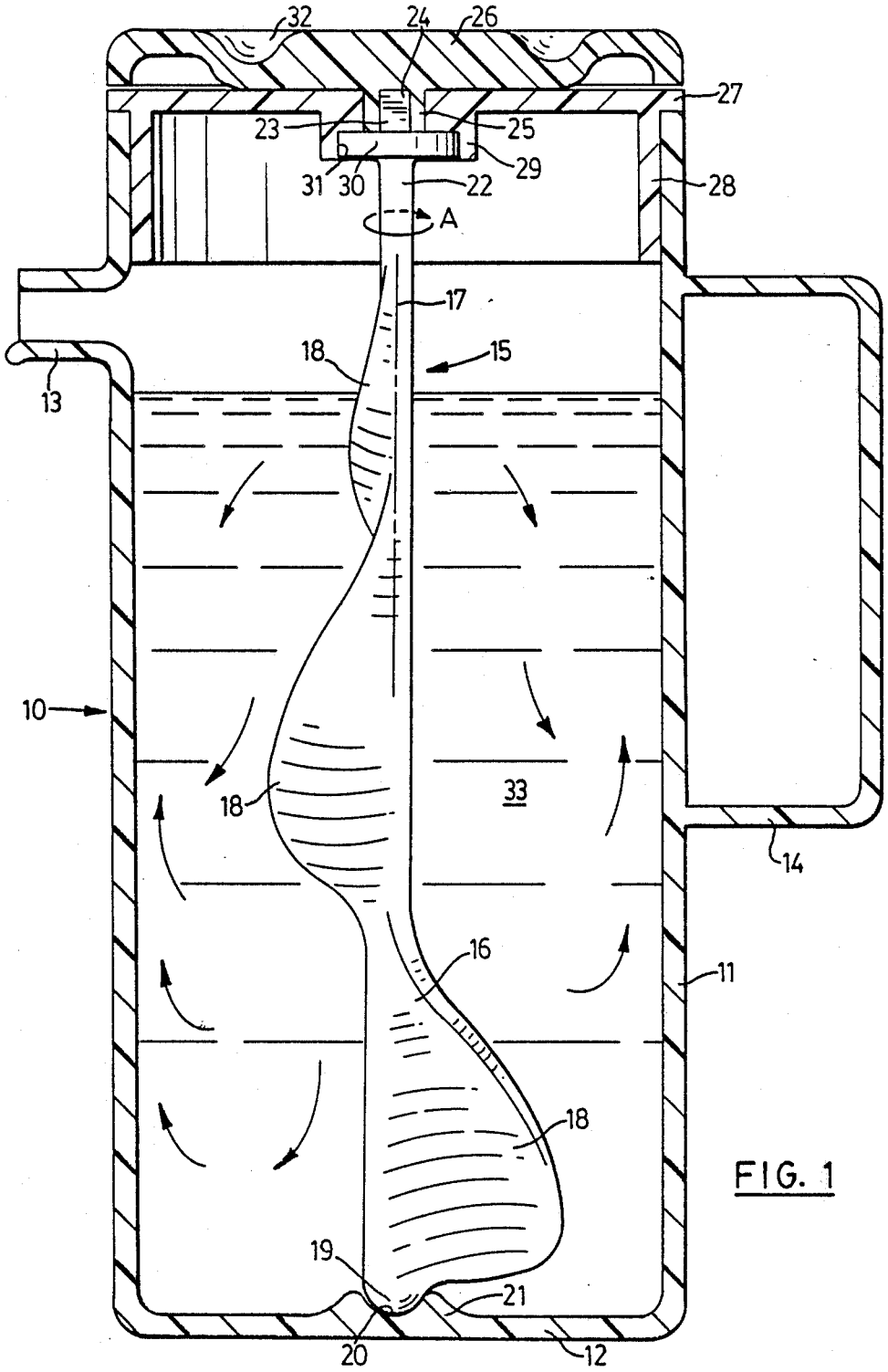

Referring to the drawings in which like reference numerals denote like parts, 10 denotes generally a beverage pitcher which comprises upstanding side walls in the form of a cylindrical wall 11 the lower end of which is closed by a base wall 12. 13 denotes a pouring spout which is provided in the upper portion of the cylindrical wall 11, and 14 denotes a handle presented by the cylindrical wall 11 diametrically opposite the pouring spout 13.

Figure 2:
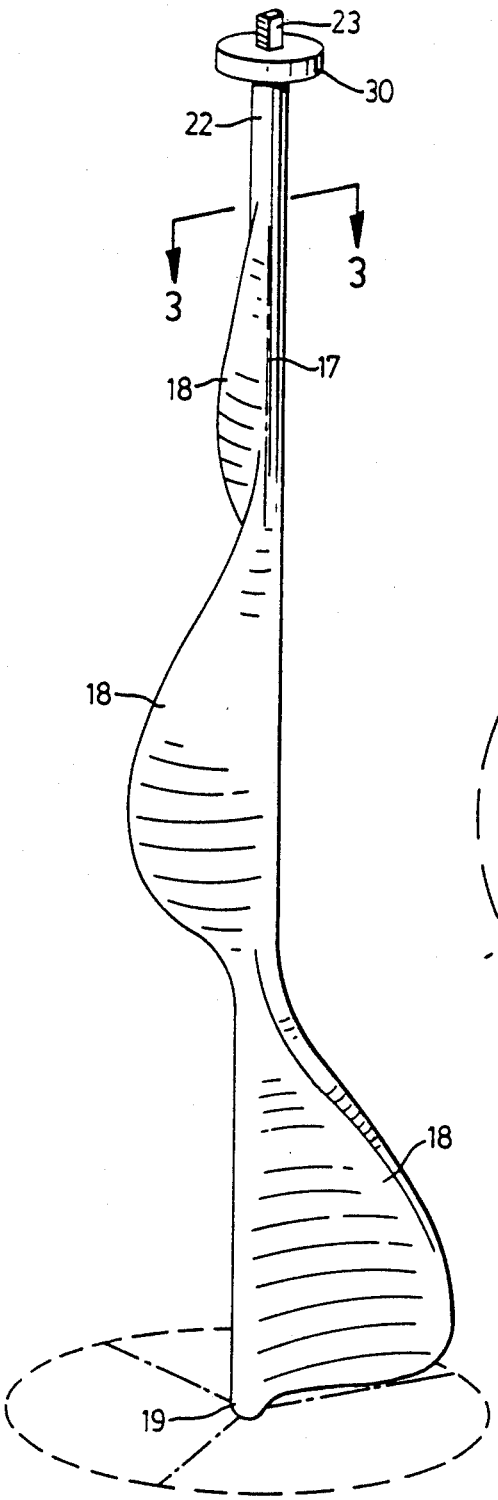
FIG. 2 is a view of a part of the stirrer device shown in FIG. 1.
Figure 3:
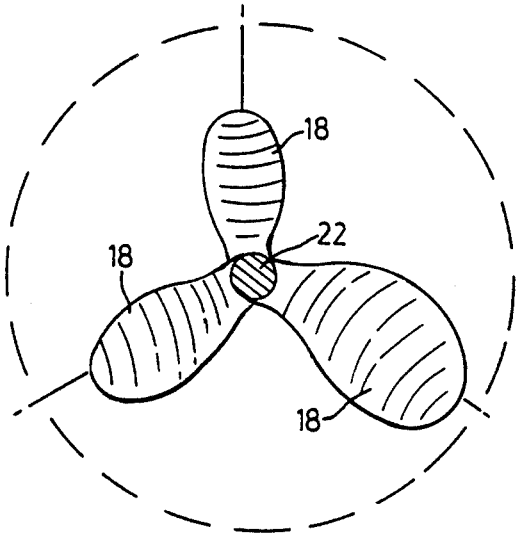
FIG. 3 is a sectioned view on the line 3—3 in FIG. 2.

Mounted within the pitcher 10 is a stirrer device 15 which comprises a stirrer preferably in the form of elongated vane means 16 have a longitudinal axis 17. In the preferred embodiment of the invention shown in the accompanying drawings the vane means 16 comprises a plurality of axially spaced vane lobes 18 each of which is of generally helical form about the longitudinal axis 17, and which, as is most clearly shown by the chain-dotted lines in FIGS. 2 and 3, are substantially equiangularly spaced about the longitudinal axis 17. At the lower first end of the vane means 16 there is provided on the longitudinal axis 17 a dome-shaped projection 19 which, as shown in FIG. 1, is operatively seated within a correspondingly shaped recess 20 provided in a boss 21 in the base wall 12 of the pitcher 10 in order to support the vane means 16 for operative rotation about the longitudinal axis 17, while extending upwardly from the upper or second end of the vane means 16 there is provided on the longitudinal axis 17 a projection 22 the upper end portion 23 of which is of square or other non-circular cross-section for releasable mounting in a non-rotatable manner within a recess 24 of corresponding cross-sectional shape in a downwardly projecting boss 25 of a plate 26, so that the plate 26 is non-rotatably mounted to the upper second end of the vane means 16 the vane means 16 is rotated about the longitudinal axis 17 on operative rotation of the plate 26. In the preferred embodiments of the invention shown in the drawings the projections 19 and 22 constitute, respectively, the lower and upper end portions of a rod which is coaxial with the longitudinal axis 17 and into which the vane means 16 constituted by the vane lobes 18 are blended, the edge of each vane lobe 18 merging smoothly from the maximum radial extent thereof towards the longitudinal axis 17.

With particular reference to the embodiment shown in FIG. 1, 27 denotes a cover lid for the pitcher 10, this cover lid 27 having a downwardly extending skirt portion 28 which is a friction fit within the upper end portion of the cylindrical wall 11 above the pouring spout 13 and the handle 14. The lid 27 is disposed below the plate 26 and has a downwardly projecting central boss 29 within which the boss 25 of the plate 26 is rotatably mounted, with a flange 30 presented by the projection 22 being journalled within a recess 31 in the lower face of the boss 29.

The upper face of the plate 26 is provided with blind fingertip recess means comprising a plurality of angularly spaced blind fingertip recesses 32 by which the plate 26, and the vane means 16, may be manually rotated in the direction indicated by the arrow A to cause the contents 33 of the pitcher 10 operatively to be urged in a downward and outward direction before flowing upwardly adjacent to the cylindrical wall 11, as indicated by the flow arrows in FIG. 1, the upper face of the plate 26 being, except for the fingertip recesses 32, substantially flush. The maximum radial extent of the vane lobes 18 from the longitudinal axis 17 decreases in the direction from the lower end to the upper end of the vane means 16 i.e. with reference to the preferred embodiments the lower vane lobe 18 has a maximum radial extent greater than that of the remaining vane lobes 18, the upper vane lobe 18 has a maximum radial extent less than that of the other vane lobes 18, and the intermediate vane lobe 18 has a maximum radial extent between that of the upper vane lobe 18 and that of the lower vane lobe 18. It will be noted from the drawings that the maximum radial extent of each of the vane lobes 18 is preferably offset from the centre of the vane lobe towards the bottom of the respective vane lobe 18.

Figure 4:
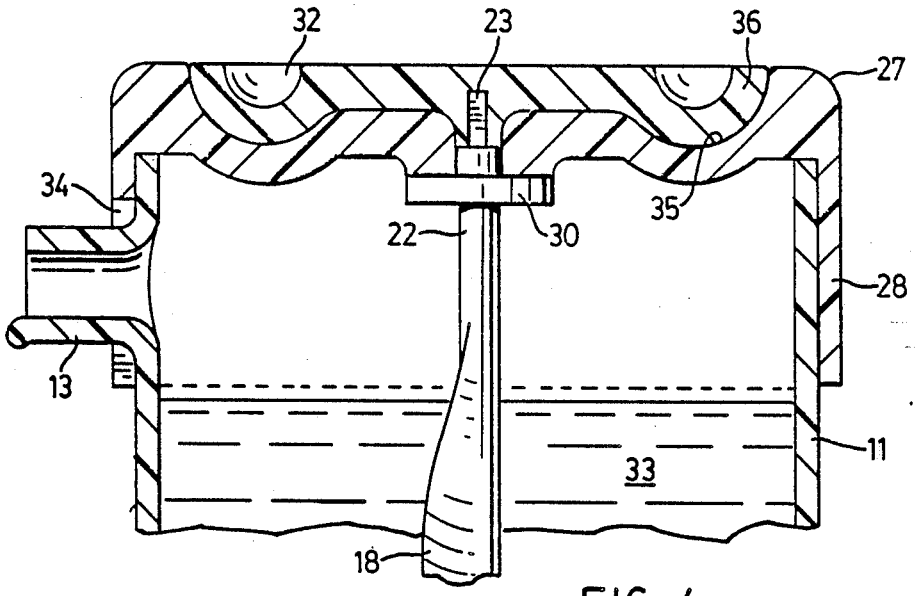
FIG. 4 is a cross-sectioned view corresponding to the upper portion of FIG. 1, but showing a further preferred embodiment of the present invention.

The embodiment shown in FIG. 4 differs from that hereinbefore described with particular reference to FIG. 1 merely in that the skirt portion 28 is a friction fit on the outside of the upper end portion of the cylindrical wall 11, with this skirt portion 28 being provided with a slot 34 within which the pouring spout 13 is operatively disposed. In addition, the cover lid 27 has an annular trough 35 with the plate 26 having a thickened annular rim 36 rotatably seated within the trough 35, the blind fingertip recesses 32 being provided in this thickened annular rim 35 of the plate 26. Furthermore, the flange 30 is disposed in contact with the lower face of the boss 29, rather than being disposed within a recess in this lower face of the boss 29.

The feature that the maximum radial extent of the vane lobes 18 from the longitudinal axis 17 decreases from the lower end to the upper end of the vane means 16 results in operative stirring and agitation of the contents 33 of the pitcher 10 being at a minimum at the maximum upper level of the contents 33 where, as is hereinbefore described, such stirring or agitation is less required and is undesirable.

I claim:

1. A stirrer device for a beverage pitcher, the stirrer device comprising elongated vane means which has a first end and an opposed second end and which comprises a plurality of axially spaced vane lobes substantially equiangularly spaced about a longitudinal axis, the maximum radial extent of the vane lobes from the longitudinal axis decreasing in the direction from said first end towards said second end of the vane means, and each vane lobe being of generally spiral form about the longitudinal axis with the edge thereof merging smoothly from the maximum radial extent of said vane lobe towards said longitudinal axis.

2. A stirrer device according to claim 1, wherein the maximum radial extent of each vane lobe is offset from the centre of the vane lobe in the direction towards said first end of the vane means.

3. A stirrer device according to claim 1, wherein a projection extends outwardly from said second end of the vane means along the longitudinal axis, and wherein the stirrer device further comprises a plate to one face of which the projection is non-rotatably mountable, the opposed face of the plate having blind fingertip recess means for operative rotation of the plate and the vane means about the longitudinal axis thereof but being otherwise substantially flush.

4. A stirrer device according to claim 3, wherein said mounting of the projection to the plate is a releasable mounting.

5. A stirrer device according to claim 3, further comprising a cover lid for the pitcher, the cover lid being mountable with said one face of the plate adjacent to the cover lid and the projection extending through the cover lid, and the plate and vane means being operatively freely rotatable relative to the cover lid.

6. In a beverage pitcher comprising a base wall, and upstanding side walls, a stirrer device which comprises elongated vane means rotatably mounted within the pitcher, the vane means having a lower end supported on the base wall and an opposed upper end, and comprising a plurality of axially spaced vane lobes which are substantially equiangularly spaced about the longitudinal axis, the maximum radial extent of the vane lobes from the longitudinal axis decreasing in the direction from said lower end towards said upper end of the vane means, and each vane lobe being of generally spiral form about the longitudinal axis with the edge thereof merging smoothly from the maximum radial extent of said vane lobe towards said longitudinal axis.

7. A pitcher according to claim 6, wherein the maximum radial extent of each vane lobe is offset from the centre of the vane lobe in the direction towards said lower end of the vane means.

8. A pitcher according to claim 6, wherein a projection extends upwardly from said upper end of the vane means along the longitudinal axis, and wherein the stirrer device further comprises a plate to a lower face of which the projection is non-rotatably mounted, an upper face of the plate having blind fingertip recess means for operative rotation of the plate and the vane means about the longitudinal axis thereof but being otherwise substantially flush.

9. A pitcher according to claim 8, wherein said mounting of the projection to the plate is a releasable mounting.

10. A pitcher according to claim 8, further comprising a cover lid mounted on the pitcher below the plate with the projection extending through the cover lid, the plate and vane means being operatively freely rotatable relative to the cover lid.

11. A stirrer device for a beverage pitcher, the stirrer device comprising elongated vane means which has a first end and an opposed second end, and a plate to one face of which the second end of the vane means is non-rotatably mountable, the opposed face of the plate having blind fingertip recess means for operative rotation of the plate and the vane means about the longitudinal axis thereof but being otherwise substantially flush, and the vane means comprising a plurality of axially spaced vane lobes which are substantially equiangularly spaced about the longitudinal axis, and each of which is of generally spiral form about the longitudinal axis, with the maximum radial extent of the vane lobes from the longitudinal axis decreasing in the direction from said first end towards said second end of the vane means.

12. A stirrer device according to claim 11, wherein said mounting of the second end of the vane means to the plate is a releasable mounting.

13. A stirrer device according to claim 11, further comprising a cover lid for the pitcher, the cover lid being mountable with said one face of the plate adjacent to the cover lid and the second end of the vane means extending through the cover lid, and the plate and the vane means being operatively freely rotatable relative to the cover lid.

14. In a beverage pitcher comprising a base wall, and upstanding side walls, a stirrer device which comprises elongated vane means rotatably mounted within the pitcher and having a lower end supported on the base wall and an opposed upper end, and a plate to the lower face of which the upper end of the vane means is non-rotatably mounted, an upper face of the plate having blind fingertip recess means for operative rotation of the plate and the vane means about the longitudinal axis thereof but being otherwise substantially flush, and the vane means comprising a plurality of axially spaced vane lobes which are substantially equiangularly spaced about the longitudinal axis, and each of which is of generally spiral form about the longitudinal axis, with the maximum radial extent of the vane lobes from the longitudinal axis decreasing in the direction from the lower end towards the upper end of the vane means.

15. A pitcher according to claim 14, wherein said mounting of the upper end of the vane means to the plate is a releasable mounting.

16. A pitcher according to claim 14, further comprising a cover lid mounted on the pitcher below the plate with the upper end of the vane means extending through the cover lid, the plate and vane means being operatively freely rotatable relative to the cover lid.

* * * * *